United States Patent [19]

Eriksson et al.

[11] 3,962,033

[45] June 8, 1976

[54] METHOD FOR PRODUCING CELLULOSE PULP

[75] Inventors: Karl-Erik Eriksson; Paul Ander; Björn Henningsson; Thomas Nilsson; Bill Goodell, all of Stockholm, Sweden

[73] Assignee: Svenska Traforskningsinstitutet and Skogshogskolan, Stockholm, Sweden

[22] Filed: Apr. 10, 1974

[21] Appl. No.: 459,553

[30] Foreign Application Priority Data

Apr. 16, 1973 Sweden ..... 7305394

[52] U.S. Cl. ..... 195/8; 195/9; 195/78

[51] Int. Cl.[2] ..... C12B 1/00; C12B 1/20

[58] Field of Search ..... 195/2, 8, 9, 10

[56] References Cited

UNITED STATES PATENTS 3,617,436 11/1971 Sundasen et al. ..... 195/10

OTHER PUBLICATIONS

Wolf et al., The Fungi vol. II, p. 44, Published by John Wiley & Sons Inc., 1947.

*Primary Examiner*—Alvin E. Tanenholtz
*Attorney, Agent, or Firm*—Oldham & Oldham Co.

[57] ABSTRACT

A method of producing cellulose pulp from a starting material containing lignin and cellulose, particularly from wood, wherein the starting material is treated with an organism capable of forming lignin-decomposing enzymes under conditions such that the lignin is substantially decomposed without appreciably affecting the cellulose.

14 Claims, No Drawings

METHOD FOR PRODUCING CELLULOSE PULP

The present invention relates to a method for producing cellulose pulp from a starting material containing lignin and cellulose and in particular from wood, in accordance with a new principle which utilizes the ability of certain micro-organisms to form lignin-decomposing enzymes to at least partially delignify said starting material. The invention is primarily intended for the manufacture of a product resembling so-called semi-chemical pulp, it being possible to further work said product by mechanical de-fibration or by chemical digestion techniques.

It is known that certain micro-organisms, so-called white rot fungi are able to break down all the constituents of wood. Such organisms often occur in wood which has been stacked in the form of chips for use as a starting material in the manufacture of chemical pulp. Since the development of these fungi results in the consumption of part of the raw material and thereby a reduction in the yield of pulp manufactured from the wood, measures have been taken to combat white rot fungi in chip stacks.

As previously mentioned, these organisms decompose all constituents of the wood, owing to the fact that said organisms produce both enzymes which decompose lignin and enzymes which decompose cellulose and other carbohydrates in the wood. The decomposition of lignin is in itself desirable, but when these organisms develop freely in, for example, a stack of wood chips they also decompose the cellulose, which is, of course, undesirable.

The prime object of the present invention is to influence white rot fungi and other micro-organisms capable of producing lignin-decomposing enzymes in a manner such that said fungi and micro-organisms specifically remove lignin from wood but do not attack cellulose and, preferably, also other carbohydrates to any appreciable extent. These fungi and micro-organisms can be influenced to produce the aforesaid result by genetically changing the same so as to reduce their ability to form cellulose-decomposing enzymes (cellulase). It is also possible to control the wood-decomposing action of the said micro-organisms in a desired direction, by using special additives, as will be hereinafter described. A further possibility resides in the addition of specific cellulase inhibitors. Finally, it also is within the scope of the invention to treat the wood with micro-organisms which while possessing a natural ability of forming lignin-decomposing enzymes will only form cellulose-decomposing enzymes to a very small degree.

Generally, the invention resides in the treatment of a starting material, such as wood, containing cellulose and lignin with an organism capable of forming lignin-decomposing enzymes under conditions whereby the lignin is substantially decomposed without the cellulose being appreciably affected in the process thereof.

In accordance with a first embodiment of the invention, the starting material is treated with an organism which possesses a natural ability to form lignin-decomposing enzymes but which is unable to produce cellulose-decomposing enzymes to any large extent. Examples of micro-organisms which can be used in this respect include *Peniophora sanguinea*, *Phellinus isabellinus*, *Polyporus resinosus*, *Trametes pini*, and in particular a newly descovered strain of Peniophora designated P-B1. This fungus belongs to the Pheniophora-cremea group, and can be characterized in the following way: mycelium hyalinous with few loops and relatively rich in clamydospores, growth rate 28 mm/day on malt agar at the optimal temperature of +35°C; optimal growth at pH 5; halophobic; good growth on mannose, cellobiose and glucose; less growth on xylose and arabinose; galactose is used hardly at all.

Peniophora cremea strain P-B1 has been thoroughly studied with respect to the liberation of cellulose and lignin in connection with birch. Subsequent to treating the wood for one month at 22°C it was found that 15% of the wood had been consumed. Analyses showed that while approximately 50% of the lignin had decomposed, decomposition of the cellulose was only 2%.

A second embodiment of the invention resides in the treatment of the starting material with a mutant of an organism having the natural ability to form lignin-decomposing and cellulose-decomposing enzymes, this mutant having a reduced ability to form cellulose-decomposing enzymes.

Suitable mutants in this respect can be obtained by treating spores of white rot fungi, e.g. Polyporus adustus or Sporotrichum pulverulentum Novobranova (which is described in the literature also under the name Chrysosporium lignorum Nilsson) with mutation-promoting agents in a known manner, e.g. by radiation with ultraviolet light. The treated spores are then subjected to a screening process in accordance with known principles for separating mutants having a reduced ability to form cellulose-decomposing enzymes (cellulase). For example, the treated spores can be spread on cellulose agar plates, whereafter substances can be added which affect the fungus so as to cause it to grow in colony form. It the cellulose-decomposing ability of a colony is unaffected by the mutation treatment, a clear zone is formed around the colony where the cellulose has been decomposed. If no such zone is formed it is taken an an indication that no cellulose-decomposing enzymes have formed, i.e. the colony in question is a cellulase negative mutant. These colonies are selected for continued cultivation, to obtain the desired organism for use in the subsequent treatment of the cellulose starting material.

Organisms which can be used for developing such mutants are primarily Polyporus and Sporotrichum pulverulentum (*Chrysosporium lignorum*) and also *Pheniophora gigantea*, *Trametes cinnabarina*, *Polyporus hirsutus*, *Pycnoporus sanguineus*, *Polyporus versicolor*, *Polyporus zonatus*.

As previously mentioned, to effect the mutation treatment process it is necessary to cause the fungus to grow in colonies on agar plates, so that desirable strains can be separated from other strains. The conditions under which colony growth of the fungi in question is obtained can either be established experimentally by those skilled in the art or, with respect to known micro-organisms, taken from the literature. For example, Polyporus adustus forms colonies at pH 3.2, while the addition of Gyposophilas saponin favours the colony growth of Sporotrichum pulverulentum. Other substances which favour colony growth with various white rot fungi are amygdalin, salicin, triterpene glucosides (aescin, avenascin, primula acid, $NH_4$ glycyrrhizinate, quillaya saponin), steroid glucosides (spirostanol glycide, spirosolanol glucoside, solanidanol glucoside).

Other fungi which do not form spores in the laboratory can also be mutated, by the fragmentation and radiation of mycelium. Examples of such fungi include

*Phellinus isabellinus*, *Trametes pini*, *Asterodon ferruginosus*, *Pholiota mutabilis*, *Polyporus abietinus*, *Polyporus rutilans*, *Stereum gausapatum*, *Stereum hirsutum*.

The production of non cellulase-producing mutants of Polyporus adustus will now be described.

Polyporus adustus spores were radiated spores ultraviolet light by placing a 20 ml aqueous suspension ($10^6$ spores) in a 9 cm Petri bowl and radiating for 5 minutes with a 30 W mercury lamp, the emission of energy of which was approximately 65% at 254 nm. The Petri bowl was placed at a distance of 150 cm from the lamp, the intensity of the lamp at this distance being $83\mu$ W/cm$^2$. 3 – 6% of the spores survived the treatment.

Mutants were selected by introducing a 1 ml suspension of mutated spores containing 150 surviving spores in a Petri bowl containing 20 ml agar medium with nutrient salts (no carbon source). The pH of the medium was adjusted to 3.2 with hydrochloric acid. Immediately subsequent to the innoculation, 8 ml of liquid agar medium (pH 3.2) were added to each plate. The medium contained 1% Walseth cellulose, 0.05% glucose and nutrient salts. Polyporus adustus forms dense colonies under these conditions. After 2 weeks those colonies which had not formed a clear zone (indicating decomposition of cellulose) were selected and subjected to further screening by cultivating same in test tubes on a cellulose medium. If the fungus failed to cause clearing of the medium after 1 month, it was considered a cellulase-less mutant and was recovered.

In this way, there were obtained 15 cellulase-less mutants among $9 \times 10^4$ colonies from Petri bowls. The ability of these mutants to decompose other polymers present in wood was then investigated more thoroughly, i.e. such polymers as xylan, glucomannan, pectin and lignin. The mutants were also investigated with respect to their ability to decompose laminarin. In order to determine the polysaccharide decomposition, the strains were cultivated in test tubes on a solid medium containing one of the polysaccharides. After 2 weeks the depth of the clear zone was measured (in mm). The degree of lignin decomposition was measured by cultivating the strains in Petri bowls with lignin agar. The quantity of lignin consumed was measured (in %) after 1 month. The following result was obtained.

TABLE I

Decomposition of cellulose, glucomannan, xylan, pectin and lignin by natural Polyporus adustus and by cellulase-less mutants.

| Strain | Substrate cellulose | xylan | glucomannan | laminarin | pectin | lignin |
|---|---|---|---|---|---|---|
| natural | 12 | 24 | 18 | 28 | 21 | 38% |
| cel-3 | 0 | 0 | 0 | 28 | 21 | 35% |
| cel-4 | 0 | 0 | 0 | 29 | 16 | 36% |
| cel-5 | 0 | 0 | 0 | 26 | 21 | 43% |
| cel-6 | 0 | 0 | 0 | 28 | 21 | 52% |
| cel-7 | 0 | 12 | 0 | 30 | 23 | 43% |
| cel-21 | 0 | 0 | 0 | 28 | 23 | 36% |
| cel-22 | 0 | 0 | 0 | 28 | 27 | 38% |
| cel-25 | 0 | 0 | 0 | 27 | 23 | 42% |
| cel-27 | 0 | 5 | 0 | 33 | 23 | 30% |
| cel-28 | 0 | 14 | 0 | 29 | 21 | 43% |
| cel-30 | 0 | 12 | 0 | 29 | 23 | 42% |
| cel-101 | 0 | 0 | 0 | 28 | 22 | 38% |
| cel-102 | 0 | 0 | 0 | 28 | 21 | 6% |
| cel-103 | 0 | 0 | 0 | 24 | 21 | — |
| cel-108 | 0 | 0 | 0 | 28 | 22 | 30% |

The results show that it is possible to produce mutants which possess essentially the same ability to decompose lignin as the natural strain but whose ability to decompose cellulose and other polysaccharides is greatly reduced and can therefore be used to delignify wood and other starting materials containing cellulose and lignin without appreciably affecting the cellulose. Mutants possessing the same properties can be obtained in a similar manner from other white rot fungi, such as Sporotrichum pulverulentum.

A further embodiment of the invention resides in the treatment of the starting material with an organism which produces both lignin-decomposing and cellulose-decomposing enzymes, while adding substances which control the decomposition process in a manner such that substantially only the lignin is decomposed. The additives in question are mainly sugars and nitrogen compounds and combinations thereof. Examples of the sugars which can be used include glucose, arabinose, cellobiose, xylose, mannose, saccharose, fructose etc., while as examples of nitrogen compounds which can be used can be mentioned primarily ammonium salts, nitrates, asparagin, casein-hydrolyzate and other organic nitrogen compounds.

Organisms which can be used when carrying out said treatment include *Peniophora sanguinea*, *Phellinus isabellinus*, *Trametes pini*, "orange rot", *Asterodon ferruginosus*, *Peniophora gigantea*, *Pholiota mutabilis*, *Polyporus resinosus*, *Polyporus abietinus*, *Polyporus hirsutus*, *Polyporus rutilans*, *Polyporus versicolor*, *Polyporus zonatus*, *Pycnoporus cinnabarinus*, *Stereum gausapatum*, *Stereum hirsutum*.

The additives generally cause the micro-organisms to change their activity in a manner such that the cellulose-decomposing activity of the organism is less manifest, while the lignin-decomposing activity remains essentially unchanged.

It is also possible to start with an organism which produces both lignin-decomposing and cellulose-decomposing enzymes while adding specific inhibitors capable of inhibiting the acitivity of the cellulose-decomposing enzymes. Tests carried out on the microbial decomposition of the cellulose and lignin, and therewith the mechanisms of the enzymes taking part, have shown that contributory to the process is an enzyme (oxidoreductase) which reduces quinones produced by the oxidation of phenols by the enzyme lachase. In order for this enzyme to function it requires quinones and cellobiose, the former being reduced to phenols and the latter oxidised to cellobionolactone. This has an inhibiting effect on the so-called $C_1$-enzyme, which is important with respect to the decomposition of the cellulose. A still more potent inhibitor is gluconolactone which is formed by a special enzyme, which splits the cellobionolactone into glucose and gluconolactone, The gluconolactone is not only inhibitory to the $C_1$-enzyme but also to $\beta$-glucosidase, which also takes part in the decomposition process of the cellulose. On the basis of these discoveries it lies within the frame of possibility to produce non-metabolizable specific inhibitors which react with the $C_1$-enzyme, so that decomposition of the cellulose is stopped. Similar inhibitors can be used to stop decomposition of xylan and mannan.

Suitable organisms for use with this embodiment are Polyporus adustus, Sporotrichum pulverulentum together with those organisms recited with reference to the other embodiments.

Treatment with microorganisms in accordance with the invention can be effected by inoculating the starting material, for example wood in chip form, with a slurry of spores of the organism in question in a medium containing the necessary nutrients for developing the microorganism and, as required, additives or inhibitors for regulating the activity of the micro-organism. For example, a stack of wood chips can be sprayed with such a slurry. The material is then allowed to stand for the required length of time so that the lignin in the wood is substantially decomposed without appreciable effect on the cellulose. Depending on the type of micro-organism used and external conditions, e.g. air temperature when the wood chips are stacked outdoors, this period of time can vary from, for example, 1 week to 1 month or several months. The material may be optionally heated, at least during the initial stages of the development of the organism, to expedite the treatment, although as a rule the organism itself maintains a suitable temperature, e.g. 30°–50°C, in the chip stack for instance. It may also be convenient to agitate and/or to aerate the material, to ensure uniform decomposition of the whole charge.

By "substantial decomposition of the lignin" is meant that at least approximately 20%, conveniently approximately 50%, and preferably approximately 75% of the lignin content of the starting material is decomposed. The extent to which the cellulose in the starting material is decomposed should not exceed 25% of the cellulose content, and preferably should not exceed 10% of said cellulose content, if an economically satisfactory pulp yield is to be obtained.

Prior to inoculating said material with the desired micro-organism, it may also be desirable to treat the starting material in a manner to destroy any undesirable cellulose-decomposing organism which may be present in the material.

The nature of the material obtained subsequent to treating the wood chips with said micro-organism is comparable with semi-chemical pulp. It can be subjected to continued digestion using chemical methods, such as sulphate, sulphite or oxygen-gas digestion, the cooking time for the same final yield being shorter than when digesting wood chips, to produce pulp having substantially the same properties as conventional chemical pulp and useful for the same purpose. Subsequent to being mechanically defibrated, it can also be used for those purposes for which semi-chemical pulp or mechanical pulp is normally used.

Even though the method of the present invention is primarily intended for the manufacture of a product which can be used as paper pulp and the like, it may also be applied for other purposes. Thus, animal food can be produced by treating starting material, e.g. straw, bagasse etc. having a high lignin content, to produce a suitable fodder using micro-organisms in accordance with the invention for reducing the lignin content of said starting material.

Microorganism cultures according to the present invention have been deposited in the Skogshogskolan Royal College of Forestry, Fack, S-104 05 Stockholm, Sweden by at least January, 1972 with the exact name and strain number or deposit number as well as the date of deposit being as follows:

| NAME | STRAIN NUMBER | DATE OF DEPOSIT |
|---|---|---|
| Polyporus adustus | Cel 3 | January, 1972 |
| Polyporus adustus | Cel 4 | January, 1972 |
| Polyporus adustus | Cel 5 | January, 1972 |
| Polyporus adustus | Cel 6 | January, 1972 |
| Polyporus adustus | Cel 7 | January, 1972 |
| Polyporus adustus | Cel 21 | January, 1972 |
| Polyporus adustus | Cel 22 | January, 1972 |
| Polyporus adustus | Cel 25 | January, 1972 |
| Polyporus adustus | Cel 27 | January, 1972 |
| Polyporus adustus | Cel 28 | January, 1972 |
| Polyporus adustus | Cel 30 | January, 1972 |
| Poly orus adustus | Cel 101 | January, 1972 |
| Polyporus adustus | Cel 102 | January, 1972 |
| Polyporus adustus | Cel 103 | January, 1972 |
| Peniophora cremea | P-B1 | December, 1970 |

The invention will now be illustrated with reference to the number of examples.

EXAMPLE 1

20 ml of a 2% malt extract solution were added to a 100 ml Erlenmeyer flask with 10 g of vermiculite (scamol). Birch blocks (20 × 20 × 10 mm) were placed in or above the vermiculite layer. The contents of the retort were then auto-claved and inoculated with a mycelium suspension of the cellulase-negative mutant Cel 6 (Table I) of *Polyporus adustus*. The contents of the retort were then incubated at room temperature for the period of time recited in Table II.

EXAMPLE 2

This test was carried out in the same manner as Example 1, although in this instance the contents of the retorts were innoculated with mutant Cel 44 of *Sporotrichum pulverulentum* (*Chrysosporium lignorum*). Cel 44 is a cellulase-less mutant of Sporotrichum, which was obtained in principally the same manner as that described above with reference to the recovery of cellulase-less mutants of Polyporus adustus.

EXAMPLE 3

20 ml of a nutrient solution comprising glucose, salts and vitamins, were added to a 100 ml Erlenmeyer flask with 10 g vermiculite. Subsequent to autoclaving the retort contents, said contents were inoculated with a mycelium suspension of *Peniophora cremea* strain P-B1. Subsequent to the growth of fungus mycelium, sterile birch blocks (10 × 10 × 10 mm) were placed in or above the vermiculite layer.

EXAMPLE 4

This test was carried out in the same manner in Example 1 with the following hauges: 30 ml of 2.5% malt extract solution were added to 15 g vermiculite. Pine sapwood blocks were placed in a number of flasks, while spruce sapwood blocks were placed in the other flasks. The fungus used was the same as used in Example 3.

EXAMPLE 5

This test was carried out in the same manner as Example 1, although in this instance the contents of the flasks were inoculated with a Trametes species, also called orange rot.

EXAMPLE 6

Spruce chips of normal quality with respect to the manufacture of pulp were introduced into 51 glass flasks. A 1% asparagin solution was poured over the chips up to the neck of the flask. After some minutes the excess solution was decanted. The flasks were autoclaved and inoculated with a mycelium suspension of *Peniophora cremea* strain P-B1.

The contents of lignin, cellulose and xylan of the sample starting material were determined in each example prior to the treatment of said material with fungus. Upon expiration of the incubation time recited in Table II, the solid wood material was separated from the liquid and corresponding determinations were made, the loss in lignin, cellulose and xylan being calculated in % by weight of the original quantity.

TABLE II

| Example | Organism | Type of Wood | Incubation Period (days) | Loss in weight (%) | Loss in lignin (%) | Loss in cellulose (%) | Loss in xylan (%) |
|---|---|---|---|---|---|---|---|
| 1 | Polyporus adustus mutant Cel 6 | Birch | 60 | 8 | 27 | 7 | 7 |
| 2 | Sporotrichum pulverulentum mutant Cel 44 | Birch | 60 | 9 | 20 | 5 | 12 |
| 3 | Peniophora cremea strain P-B1 | Birch | 30 | 15 | 50 | 2 | 14 |
| 4 | The same | Pine | 66 | 14 | 28 | 0 | 10 |
| | | Spruce | | 16 | 25 | 4 | 24 |
| 5 | Trametes species orange rot | Birch | 56 | 13 | 48 | 4 | — |
| 6 | Pheniophora cremea strain P-B1 | Spruce | 40 | 4 | 7 | 2 | — |

The results in Table II showed the fungi used are able to selectively decompose lignin in wood whilst only slightly affecting cellulose and xylan.

The nature of the wood remaining with Examples 1 – 6 was essentially the same as that of semi-chemical pulp produced from wood chips.

We claim:

1. A method of producing cellulose pulp from a starting material containing lignin and cellulose, comprising, treating the starting material with an artificially produced mutant of an organism capable of naturally forming lignin-decomposing and cellulose-decomposing enzymes, wherein the ability of the mutant to form cellulose-decomposing enzymes is reduced.

2. A method according to claim 1, including treating the starting material with a mutant strain of Polyporus adustus or Chyrosporium lignorum obtained by ultraviolet radiation of spores to form mutants thereof having a reduced ability to decompose cellulose, and using only such mutants in the treatment of the starting material.

3. A method of producing cellulose pulp from a starting material containing lignin and cellulose, comprising, treating the starting material with an organism capable of forming lignin-decomposing and cellulose-decomposing enzymes, and adding substances which control the decomposition process so that primarily only the lignin is decomposed.

4. A method according to claim 3, including using a new strain of Peniophora cremea designated PB-1 as the organism.

5. A method of producing cellulose pulp from a starting material containing lignin and cellulose, comprising, treating the starting material with an organism capable of forming lignin-decomposing and cellulose-decomposing enzymes, and adding substances which inhibit the cellulose-decomposing enzymes.

6. A method according to claim 1, including subjecting the obtained product to mechanical or chemical treatment to release the fibres therein.

7. A method as in claim 1 including decomposing from approximately 20% to approximately 75% of the lignin of the starting material whilst decomposing no more than 25% of the cellulose content of the starting material.

8. A method according to claim 1, wherein said starting material is wood.

9. A method according to claim 3, including subjecting the obtained product to mechanical or chemical treatment to release the fibers therein.

10. A method as in claim 3, including decomposing from approximately 20 percent to approximately 75 percent of the lignin of the starting material while decomposing no more than 25 percent of the cellulose content of the starting material.

11. A method according to claim 3, wherein said starting material is wood.

12. A method according to claim 5, including subjecting the obtained product to mechanical or chemical treatment to release the fibers therein.

13. A method as in claim 5, including decomposing from approximately 20 percent to approximately 75 percent of the lignin of the starting material while decomposing no more than 25 percent of the cellulose content of the starting material.

14. A method according to claim 5, wherein said starting material is wood.

* * * * *